US010603239B2

(12) United States Patent
Keepers et al.

(10) Patent No.: US 10,603,239 B2
(45) Date of Patent: Mar. 31, 2020

(54) LATERAL HIP AND LEG STRETCHING MACHINE AND METHODS FOR USING THE SAME

(71) Applicants: Wesley A. Keepers, Bryan, TX (US); Kelly Nicole Nelms, The Woodlands, TX (US)

(72) Inventors: Wesley A. Keepers, Bryan, TX (US); Kelly Nicole Nelms, The Woodlands, TX (US)

( * ) Notice: Subject to any disclaimer, the term of this patent is extended or adjusted under 35 U.S.C. 154(b) by 520 days.

(21) Appl. No.: 15/615,385

(22) Filed: Jun. 6, 2017

(65) Prior Publication Data

US 2017/0348170 A1 Dec. 7, 2017

Related U.S. Application Data

(60) Provisional application No. 62/346,791, filed on Jun. 7, 2016.

(51) Int. Cl.
*A61H 1/00* (2006.01)
*A61H 1/02* (2006.01)*A63B 21/00* (2006.01)

(Continued)

(52) U.S. Cl.
CPC ..... *A61H 1/00* (2013.01); *A61H 1/02* (2013.01); *A61H 1/0244* (2013.01);

(Continued)

(58) Field of Classification Search
CPC ..... A61H 1/00; A61H 1/02; A61H 1/0229; A61H 1/0237; A61H 1/0244; A61H 2001/0203; A61H 2001/0207; A61H 2001/0211; A61H 2001/0248; A61H 2001/0251; A61H 2203/0456; A61H 2201/1642; A61H 2201/5007; A61H 2201/1409; A61H 2201/5051; A61H 2201/123; A61H 2201/1246; A61H 2201/5043; A61H 2201/0192; A61H 2201/1671; A61H 2201/5056;

(Continued)

(56) References Cited

U.S. PATENT DOCUMENTS 3,661,149 A * 5/1972 Ferries ..... A61H 1/0237 601/35
4,647,040 A * 3/1987 Ehrenfried ..... A61H 1/02 482/131

(Continued)

*Primary Examiner* — Bradley H Philips
*Assistant Examiner* — Vincent D Hoang
(74) *Attorney, Agent, or Firm* — Harness, Dickey & Pierce, P.L.C.

(57) ABSTRACT

A stretching machine includes a table having a surface for supporting a patient and a first leg rest for supporting and moving a first leg of the patient. The first leg rest has a first vertical frame operable to rotate around a first horizontal pivot point at an end of the table and a first horizontal frame operable to rotate around a first vertical pivot point on the first vertical frame. A first vertical actuator is for rotating the first vertical frame around the first horizontal pivot point to move the first leg rest in a vertical direction relative to the surface of the table, and a first horizontal actuator is for rotating the first horizontal frame around the first vertical pivot point to move the first leg rest in a horizontal direction relative to the first vertical frame.

20 Claims, 11 Drawing Sheets

(51) Int. Cl.
*A63B 23/02* (2006.01)
*A63B 23/00* (2006.01)

(52) U.S. Cl.
CPC ..... *A61H 1/0229* (2013.01); *A61H 1/0237* (2013.01); *A61H 2001/0203* (2013.01); *A61H 2001/0207* (2013.01); *A61H 2001/0211* (2013.01); *A61H 2001/0248* (2013.01); *A61H 2001/0251* (2013.01); *A61H 2201/0192* (2013.01); *A61H 2201/123* (2013.01); *A61H 2201/1246* (2013.01); *A61H 2201/1409* (2013.01); *A61H 2201/1642* (2013.01); *A61H 2201/1671* (2013.01); *A61H 2201/5007* (2013.01); *A61H 2201/5043* (2013.01); *A61H 2201/5051* (2013.01); *A61H 2201/5056* (2013.01); *A61H 2203/0456* (2013.01); *A63B 21/4029* (2015.10); *A63B 21/4031* (2015.10); *A63B 23/0216* (2013.01); *A63B 2023/006* (2013.01)

(58) Field of Classification Search
CPC ..... A63B 21/4029; A63B 21/4031; A63B 2023/006; A63B 23/0216
See application file for complete search history.

(56) References Cited

U.S. PATENT DOCUMENTS

| | | | | | |
|---|---|---|---|---|---|
| 5,122,106 | A * | 6/1992 | Atwood | A61H 1/0244 | 482/131 |
| 5,277,681 | A * | 1/1994 | Holt | A61H 1/02 | 482/112 |
| 5,421,801 | A * | 6/1995 | Davies, III | A61H 1/0244 | 482/131 |
| 6,733,426 | B2 * | 5/2004 | Bussell | A63B 21/0083 | 482/112 |
| 6,821,231 | B1 * | 11/2004 | Hall | A63B 23/0429 | 482/131 |
| 7,153,251 | B2 * | 12/2006 | Broadbent | A61H 1/0237 | 482/148 |
| 7,235,039 | B2 | 6/2007 | Anders | | |
| 2008/0032877 | A1 * | 2/2008 | Denisco | A61H 1/0244 | 482/145 |
| 2009/0098984 | A1 * | 4/2009 | Smyrk | A61H 1/0244 | 482/72 |
| 2016/0302988 | A1 * | 10/2016 | Heimann | A63B 21/0023 | |

* cited by examiner

LATERAL HIP AND LEG STRETCHING MACHINE AND METHODS FOR USING THE SAME

CROSS-REFERENCE TO RELATED APPLICATIONS

This application claims the benefit of U.S. Provisional Application No. 62/346,791, filed on Jun. 7, 2016. The entire disclosure of the above application is incorporated herein by reference.

FIELD

The present disclosure relates to physical therapy techniques and, more specifically, to a lateral hip and leg stretching machine and methods for using the same.

BACKGROUND

This section provides background information related to the present disclosure which is not necessarily prior art.

Iliotibial (IT) band stretches are commonly prescribed by doctors, physical therapists, personal trainers and other healthcare professionals to alleviate pain in the hip, knees, and/or along the IT band due to chronic overuse and repetition. Examples include runners' knee, iliotibial band syndrome (ITBS) or iliotibial band friction syndrome (ITBFS), hip bursitis, sciatica, and patella mal-tracking. However, IT band stretches are hard for individual patients to perform, thus requiring travel to a healthcare office or appropriate training facility and the assistance of a skilled and properly trained healthcare professional.

In particular, manual IT band stretches require that the patient maintain both legs straight (or with slight flexion in the knee up to 30 degrees), extend one leg across the body, and then apply a downward force to that leg, all while keeping the hips anchored to the floor. Under these conditions, it is very difficult for the patient to replicate the forces normally applied by a healthcare professional and needed to properly perform the stretch.

SUMMARY

This section provides a general summary of the disclosure, and is not a comprehensive disclosure of its full scope or all of its features.

A stretching machine according to the present teachings includes a table having a surface for supporting a patient and a first leg rest for supporting and moving a first leg of the patient. The first leg rest has a first vertical frame operable to rotate around a first horizontal pivot point at an end of the table and a first horizontal frame operable to rotate around a first vertical pivot point on the first vertical frame. A first vertical actuator is for rotating the first vertical frame around the first horizontal pivot point to move the first leg rest in a vertical direction relative to a surface of the table, and a first horizontal actuator is for rotating the first horizontal frame around the first vertical pivot point to move the first leg rest in a horizontal direction relative to the first vertical frame.

The stretching machine may further include a second leg rest for supporting and moving a second leg of the patient. The second leg rest may have a second vertical frame operable to rotate around a second horizontal pivot point at an end of the table, and a second horizontal frame operable to rotate around a second vertical pivot point on the second vertical frame. A second vertical actuator may be for rotating the second vertical frame around the second horizontal pivot point to move the second leg rest in a vertical direction relative to the surface of the table, and a second horizontal actuator may be for rotating the second horizontal frame around the second vertical pivot point to move the leg rest in a horizontal direction relative to the second vertical frame.

The stretching machine may further include a second vertical leg controller operable to send a control signal to the second vertical linear actuator to control the rotational movement of the second vertical frame around the second horizontal pivot point to move the second leg rest in the vertical direction, and a second horizontal leg controller operable to send a control signal to the second horizontal actuator to control the rotational movement of the second horizontal frame around the second vertical pivot point to move the second leg rest in the horizontal direction.

The stretching machine may further include a second vertical actuator that comprises a linear actuator.

The stretching machine may further include a second horizontal actuator that comprises a linear actuator.

The stretching machine may further include a first vertical leg controller operable to send a control signal to the first vertical linear actuator to control the rotational movement of the first vertical frame around the first horizontal pivot point to move the first leg rest in the vertical direction, and a first horizontal leg controller operable to send a control signal to the first horizontal actuator to control the rotational movement of the first horizontal frame around the first vertical pivot point to move the first leg rest in the horizontal direction.

The stretching machine may further include a first vertical actuator that comprises a linear actuator.

The stretching machine may further include a first horizontal actuator that comprises a linear actuator.

The stretching machine may further include a restraining mechanism for restraining a lower portion of a torso of the patient on the table during motion of the leg.

The stretching machine may further include a restraining mechanism that is a restraint belt having a quick release fastener.

The stretching machine may further include a restraining mechanism that is a restraint belt having a padded cushion.

The stretching machine may further include a first vertical actuator that rotates the first vertical frame to move the first leg rest in a vertical direction to an angle between 0 and 90 degrees relative to the surface of the table.

The stretching machine may further include a first horizontal actuator that rotates the first horizontal frame to move the first leg rest in the horizontal direction to an angle between 0 and 85 degrees relative to the first vertical frame.

A method for using a stretching machine having a table and at least one leg rest includes sending, by a vertical leg controller, a control signal to a vertical actuator controlling rotational movement of a vertical frame around a horizontal pivot point at an end of the table to move the leg rest in a vertical direction relative to the surface of the table; sending, by a horizontal leg controller, a control signal to a horizontal actuator controlling rotational movement of a horizontal frame around a vertical pivot point on the vertical frame to move the leg rest in a horizontal direction relative to the vertical frame; moving, by the vertical actuator, the leg rest to an angle in the vertical direction relative to the surface of the table; and moving, by the horizontal actuator, the leg rest to an angle in the horizontal direction relative to the vertical frame.

The method may further include selecting, by a patient, an up or down command on the vertical leg controller to control the rotational movement of the vertical frame and move the leg rest in an up or down direction relative to the surface of the table.

The method may further include selecting, by a patient, a left or right command on the horizontal leg controller to control the rotational movement of the horizontal frame and move the leg rest in a left or right direction relative to the vertical frame.

The method may further include moving the leg rest to an angle in the vertical direction that is between 0 and 90 degrees.

The method may further include moving the leg rest to an angle in the horizontal direction that is between 0 and 85 degrees.

The method may further include a first vertical actuator that is a linear actuator.

The method may further include a first horizontal actuator that is a linear actuator.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1A:
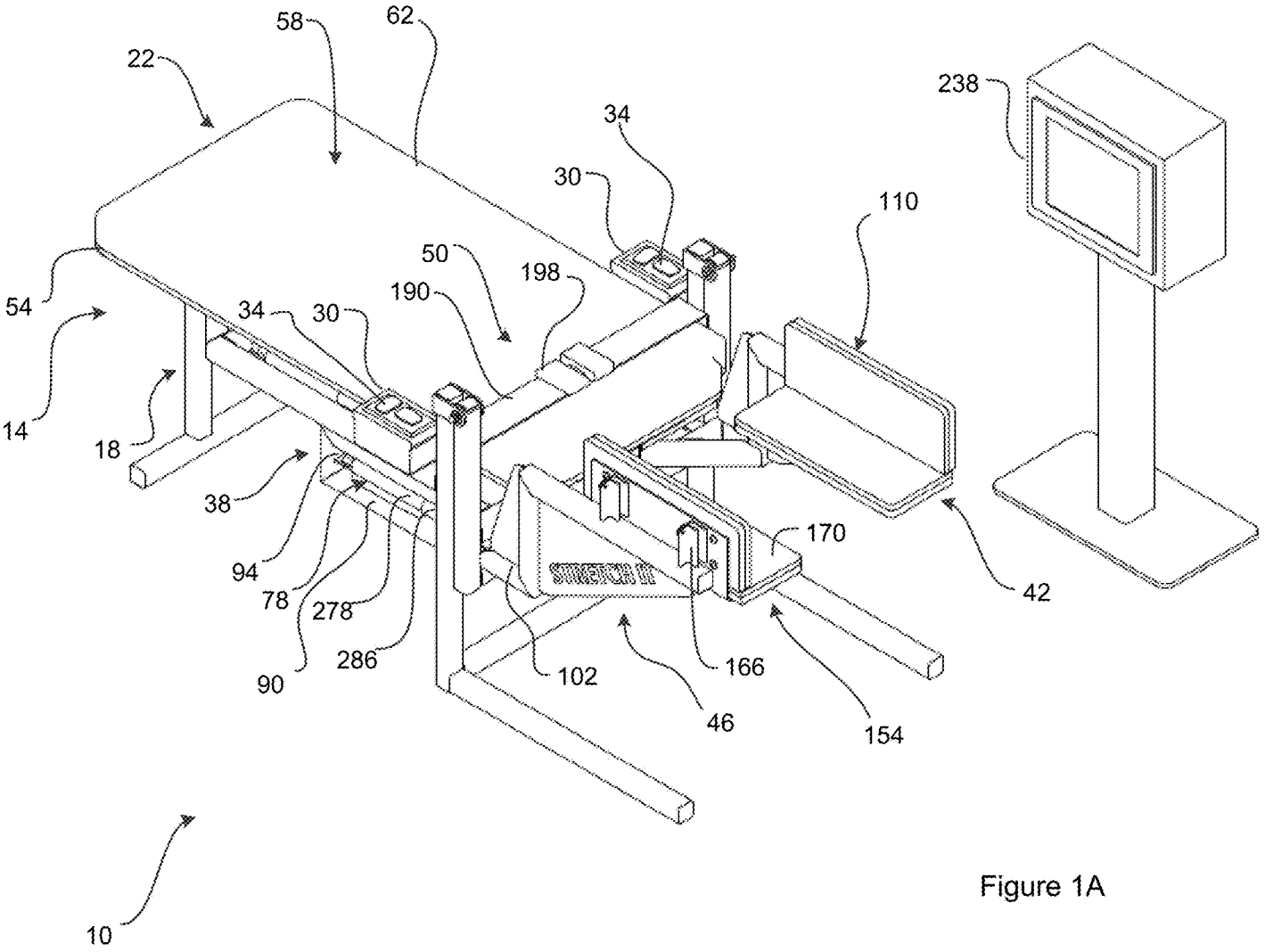
FIGS. 1A and 1B illustrate a perspective view and a side view, respectively, of a lateral hip and leg stretching machine of the present disclosure demonstrating a left leg rest and a right leg rest in neutral positions.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Iliotibial (IT) band stretches are commonly prescribed by doctors, physical therapists, personal trainers, and other healthcare professionals to alleviate pain in the hip, knees and/or along the IT band due to chronic overuse and repetition. A lateral hip and leg stretching machine as described herein allows an individual patient to safely and effectively produce the movements performed by a healthcare professional during an IT band stretch. The lateral hip and leg stretching machine thus realizes significant benefits, including reducing travel time to and from a healthcare professional and decreasing disruption of the patient's schedule. The lateral hip and leg stretching machine further allows the patient to perform the critical rehabilitation procedures without assistance from a healthcare professional and at a pace that is consistent with the patient's recovery and flexibility. The lateral hip and leg stretching machine is easy to operate, easy to keep clean and maintain, comfortable, and safely and effectively stretches the targeted area(s). Since every person is different, the lateral hip and leg stretching machine is able to accommodate a wide range of sizes, weights, and flexibilities, including a target population ranging from 5'0" to 6'5" in height and weights up to 300 lbs.

Figure 1B:
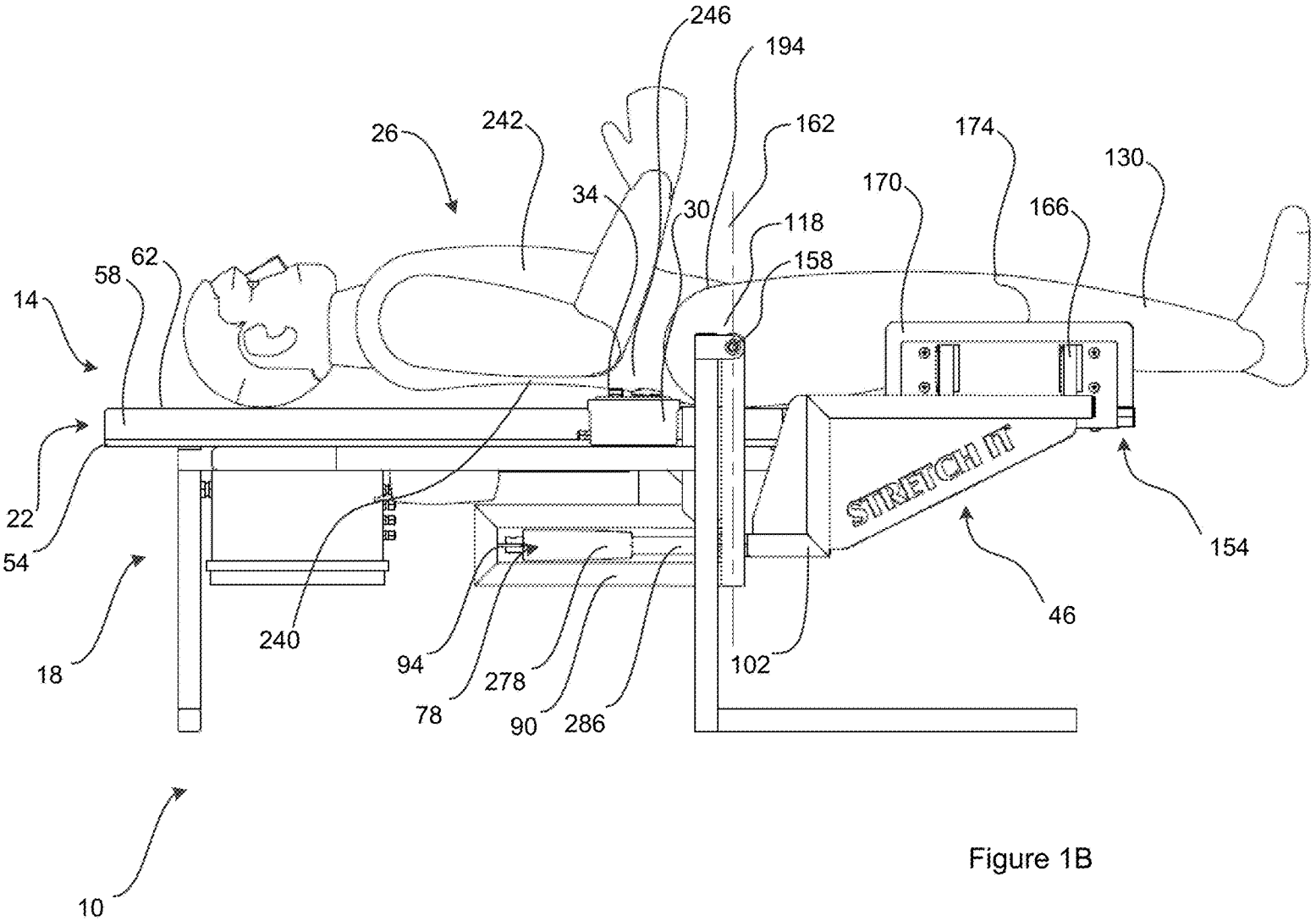

Referring to FIGS. 1A-4, and specifically FIGS. 1A and 1B, a lateral hip and leg stretching machine 10 according to the present teachings is illustrated. The lateral hip and leg stretching machine 10 includes a table 14. In some embodiments, the table 14 may be a stationary table. In other embodiments, a rolling or otherwise movable table may be implemented. The table 14 consists of a table frame 18 and a table cushion 22. The table frame 18 may be an assembly of pieces welded together, where the pieces are formed of a metal, for example, aluminum, steel, titanium or other suitable metal. In other embodiments, the table frame 18 may be an assembly of pieces connected together by, for example, bolts, screws, or other fixing members. In this case, the table frame 18 may be formed of a material other than metal, such as, for example, a plastic, carbon fiber, composite, or other suitable material.

The table frame 18 supports a patient 26, provides stability when operating the machine 10, and incorporates a mount 30 for user controls and indicators 34. The table frame 18 also supports linear actuators 38, a movable left leg rest 42, a movable right leg rest 46, and a restraint belt 50. In some embodiments, wheels may be provided on one end to allow for easy movement of the machine by a single person.

The table cushion 22 consists of a plate 54 that supports a foam pad 58. In some embodiments, the foam pad 58 may be flat or contoured to provide proper head, neck and lumbar support. In embodiments where the foam pad 58 is flat, a separate head rest or cushion may be provided on the foam pad 58. A cover 62 of a desired color encloses the foam pad 58 to protect the foam pad 58. In some embodiments, the cover 62 may be an antimicrobial fabric that provides an appropriate hygienic cleanliness for multiple users.

Figure 5:
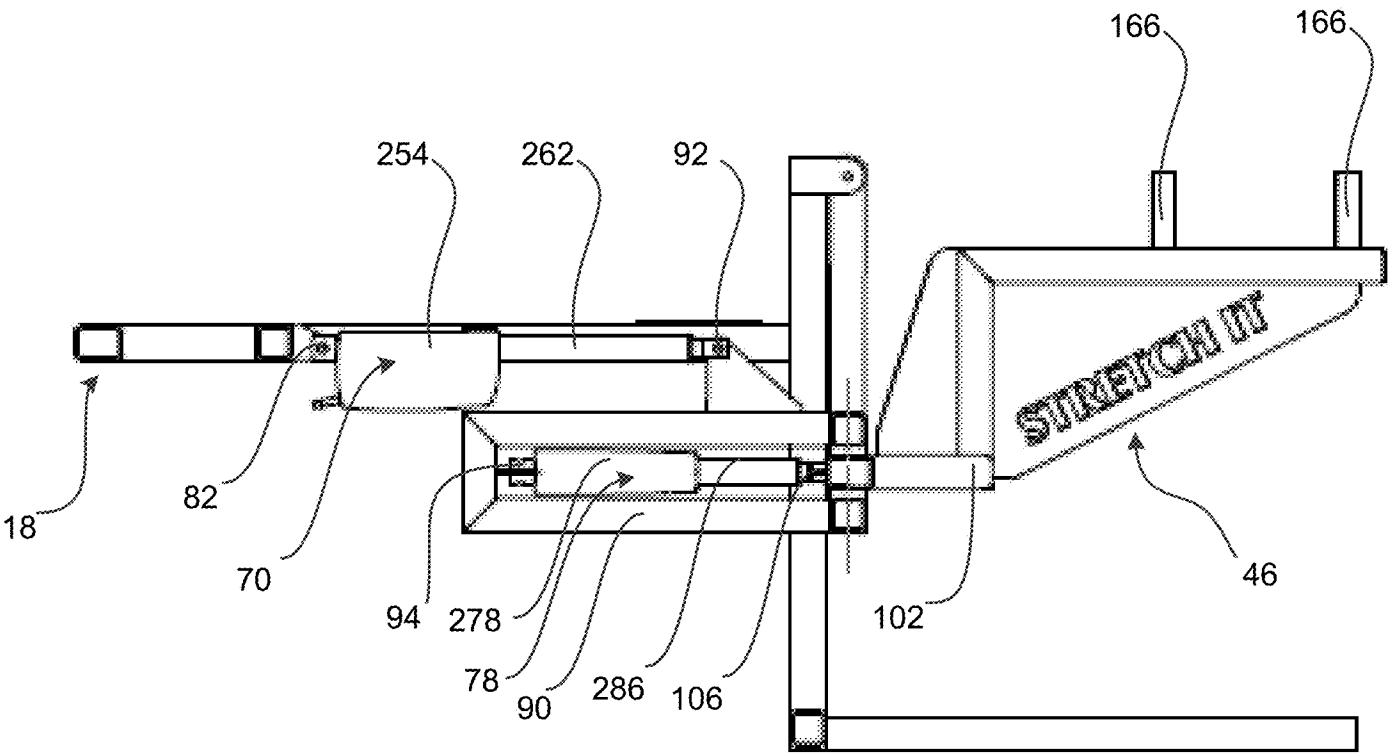
FIG. 5 illustrates a side view of a portion of the right side of the lateral hip and leg stretching machine.
Figure 6:
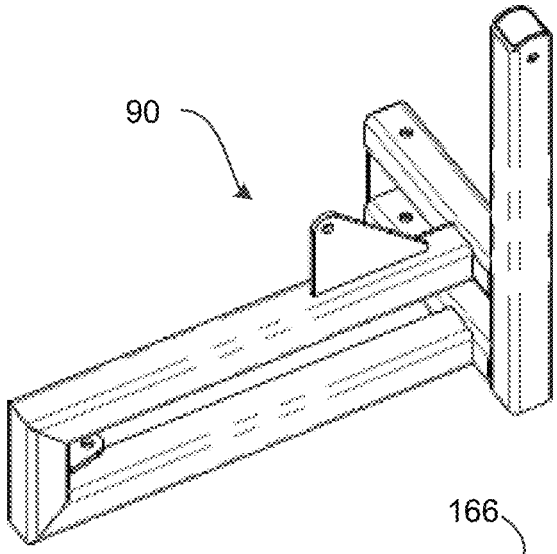
FIG. 6 illustrates a perspective view of a right vertical swing frame of the lateral hip and leg stretching machine.
Figure 7:
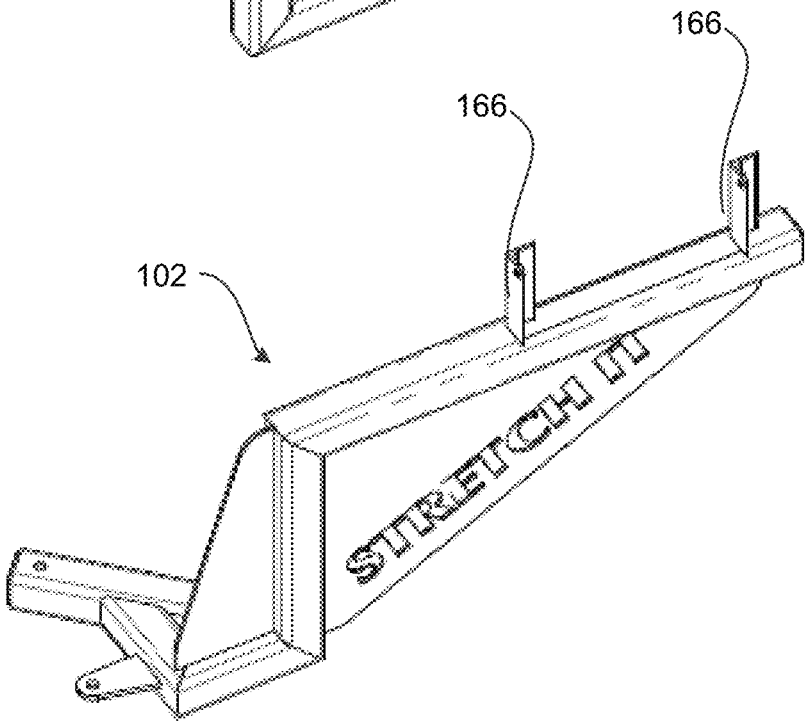
FIG. 7 illustrates a perspective view of a right horizontal swing frame of the lateral hip and leg stretching machine.
Figure 8:
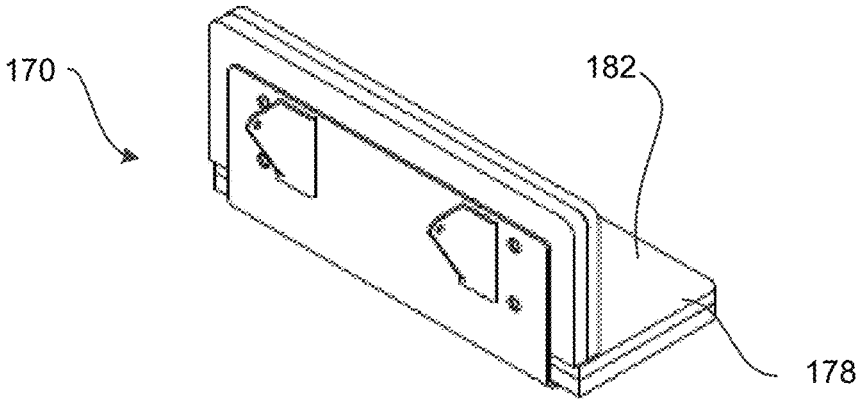
FIG. 8 illustrates a perspective view of a right leg support cushion of the lateral hip and leg stretching machine.

The linear actuators 38 are selected to provide the appropriate range of motion while providing sufficient force to enable the desired level of stretch. The lateral hip and leg stretching machine 10, includes one (1) vertical linear actuator 66, 70 and one (1) horizontal linear actuator 74, 78 to control each leg rest 42, 46. Although one vertical and one horizontal linear actuator per each leg rest is illustrated and described in detail, the lateral hip and leg stretching machine 10 may include more than one vertical and one horizontal linear actuator for each leg rest. The vertical linear actuator 66, 70 is pinned or otherwise connected to the table frame 18 on a first end 82 and pinned to a respective left vertical swing frame 86 or right vertical swing frame 90 of the respective left leg rest 42 or right leg rest 46 on a second, opposing end 92. The horizontal linear actuator 74, 78 is pinned or otherwise connected to the respective left vertical swing frame 86 or right vertical swing frame 90 on a first end 94 and to a respective left horizontal swing frame 98 or right horizontal swing frame 102 on a second, opposing, end 106 (FIG. 5). Each linear actuator 66, 70, 74, 78 is controlled independently by the user or patient 26 through the user controls 34. Referring to FIGS. 6-8, the right vertical swing frame 90, the right horizontal swing frame 102, the right vertical linear actuator 70, the right horizontal linear actuator 78, and the right leg support cushions 170 are illustrated in further detail. Although not pictured in detail, the left vertical swing frame 86, the left horizontal swing frame 98, the left vertical linear actuator 66, the left horizontal linear actuator 74, and the left leg support cushion 138 are similar to the right vertical swing frame 90, the right horizontal swing frame 102, the right vertical linear actuator 70, the right horizontal linear actuator 78, and the right leg support cushions 170.

Movement of both the left vertical linear actuator 66 and right vertical linear actuator 70 are based on an extension rod 258, 262 that extends from the actuator body 250 of the left vertical linear actuator 66 and the actuator body 254 of the right vertical linear actuator 70, respectively. The motion and position of the right vertical linear actuator 70 and left vertical linear actuator 66 are controlled using a built in electric motor and gear assembly 266 acting on a screw 270. In some embodiments, screw 270 may be, for example, an ACME screw. In other embodiments, screw 270 may be a threaded rod that turns in response to movement by the gear assembly 266.

As the screw 270 is turned by the motor and gear assembly 266, the extension rod 258, 262 extends or retracts in response to control input by the patient 26. This extension and retraction controls the position of the vertical swing frame 86, 90 and the position of the patient's respective leg to enable the stretch of the leg muscle.

Referring to FIGS. 1A-3B, the left leg rest 42 is an assembly of the left vertical swing frame 86, the left horizontal swing frame 98, and a left leg support 110. In some embodiments, the left vertical swing frame 86 is a metal weldment formed of steel, aluminum, titanium, or other metal that may be welded. In other embodiments, the left vertical swing frame 86 may be an assembly of parts that are connected by bolts, screws, pins, or other fasteners. In these embodiments, the parts comprising the assembly may be formed of a material other than metal, for example, plastic, carbon fiber, composite, or other suitable material. The left vertical swing frame 86 is pinned on a horizontal axis 114 that passes through a hip joint 118 of the patient 26, which ensures that the left vertical swing frame 86 rotates concentrically with the patient's leg 122 and prevents relative movement between the left leg support 110 and the patient's left leg 122. The left vertical swing frame 86 is pinned or otherwise connected to the left vertical linear actuator 66 and can rotate from rest (neutral) to an angle sufficient to provide the appropriate stretch in the up or down direction. For example only, the left vertical swing frame 86 may rotate to an angle within the range of 0 degrees (°) to 90° relative to a top surface of the table 14 and may be set to an angle specific for each patient and each therapy session.

The left horizontal swing frame 98 is pinned on a vertical axis 126 that passes through the patients' hip joint 118, which ensures that the left horizontal swing frame 98 rotates concentrically with the patient's left leg 122 and prevents relative movement between the left leg support 110 and the patient's left leg 122. The vertical axis 126 intersects the horizontal axis 114 at the patient's hip joint 118. In some embodiments, the left horizontal swing frame 98 is a metal weldment formed of steel, aluminum, titanium, or other metal that may be welded. In other embodiments, the left horizontal swing frame 98 may be an assembly of parts that are connected by bolts, screws, pins, or other fasteners. In these embodiments, the parts comprising the assembly may be formed of a material other than metal, for example, plastic, carbon fiber, composite, or other suitable material. The left horizontal swing frame 98 is pinned to the left horizontal linear actuator 74 and can rotate from rest (neutral) to an angle sufficient to provide the appropriate stretch. For example only, the left horizontal swing frame 98 may rotate to an angle within the range of 0 degrees (°) to 85° relative to the left vertical swing frame 86 and may be set to an angle specific for each patient and each therapy session. The left horizontal swing frame 98 remains clear of the patients' stationary (right) leg 130 to prevent contact between the stationary (right) leg 130 and the moving assembly.

The left horizontal swing frame 98 incorporates brackets 134 to mount left leg support cushions 138. The leg support cushions 138 provide support on the underside and the outside of the patient's left leg 122. In particular, the left leg support cushions 138 are positioned in order to properly anchor the left knee 142 while providing adequate support during the stretch. The profile of the cushions 138 provide comfort to the patient. The left leg support cushions 138 include a pad 146 and a cover 150. The cover 150 is of a desired color and covers the left leg support cushion pad 146 to provide protection of the foam. In some embodiments, the cover may be an antimicrobial fabric to provide an appropriate hygienic cleanliness for multiple patients.

Referring to FIGS. 1A-3B, the right leg rest 46 is an assembly of the right vertical swing frame 90, the right horizontal swing frame 102, and a right leg support 154. In some embodiments, the right vertical swing frame 90 is a metal weldment formed of steel, aluminum, titanium, or other metal that may be welded. In other embodiments, the right vertical swing frame 90 may be an assembly of parts that are connected by bolts, screws, pins, or other fasteners. In these embodiments, the parts comprising the assembly may be formed of a material other than metal, for example, plastic, carbon fiber, composite, or other suitable material. The right vertical swing frame 90 is pinned on a horizontal axis 158 that passes through the hip joint 118 of the patient 26, which ensures that the right vertical swing frame 90 rotates concentrically with the patient's right leg 130 and prevents relative movement between the right leg support 154 and the patient's right leg 130. The right vertical swing frame 90 is pinned or otherwise connected to the right vertical linear actuator 70 and can rotate from rest (neutral) to an angle sufficient to provide the appropriate stretch in the up or down direction. For example only, the right vertical swing frame 90 may rotate to an angle within the range of 0° to 90° relative to a top surface of the table 14 and may be set to an angle specific for each patient and each therapy session.

The right horizontal swing frame 102 is pinned on a vertical axis 162 that passes through the patient's hip joint 118, which ensures that the right horizontal swing frame 102 rotates concentrically with the patient's right leg 130 and prevents relative movement between the right leg support 154 and the patient's right leg 130. The vertical axis 162 intersects the horizontal axis 158 at the patient's hip joint 118. In some embodiments, the right horizontal swing frame 102 is a metal weldment formed of steel, aluminum, titanium, or other metal that may be welded. In other embodiments, the right horizontal swing frame 102 may be an assembly of parts that are connected by bolts, screws, pins, or other fasteners. In these embodiments, the parts comprising the assembly may be formed of a material other than metal, for example, plastic, carbon fiber, composite, or other suitable material. The right horizontal swing frame 102 is pinned to the right horizontal linear actuator 78 and can rotate from rest (neutral) to an angle sufficient to provide the appropriate stretch. For example only, the right horizontal swing frame 102 may rotate to an angle within the range of 0° to 85° relative to the right vertical swing frame 90 and may be set to an angle specific for each patient and each therapy session. The right horizontal swing frame 102 remains clear of the patient's stationary (left) leg 122 to prevent contact between the stationary (left) leg 122 and the moving assembly.

The right horizontal swing frame 102 incorporates brackets 166 to mount right leg support cushions 170. The right leg support cushions 170 provide support on the underside and the outside of the patient's right leg 130. The right leg support cushions 170 are positioned in order to properly anchor the right knee 174 while providing adequate support during the stretch. The profile of the cushions 170 provides comfort to the patient 26. The right leg support cushions 170 include a pad 178 and a cover 182. The cover 182 is of a desired color and covers the right leg support cushion pad 178 to provide protection of the foam. In some embodiments, the cover 182 may be an antimicrobial fabric to provide an appropriate hygienic cleanliness for multiple patients.

Figure 2A:
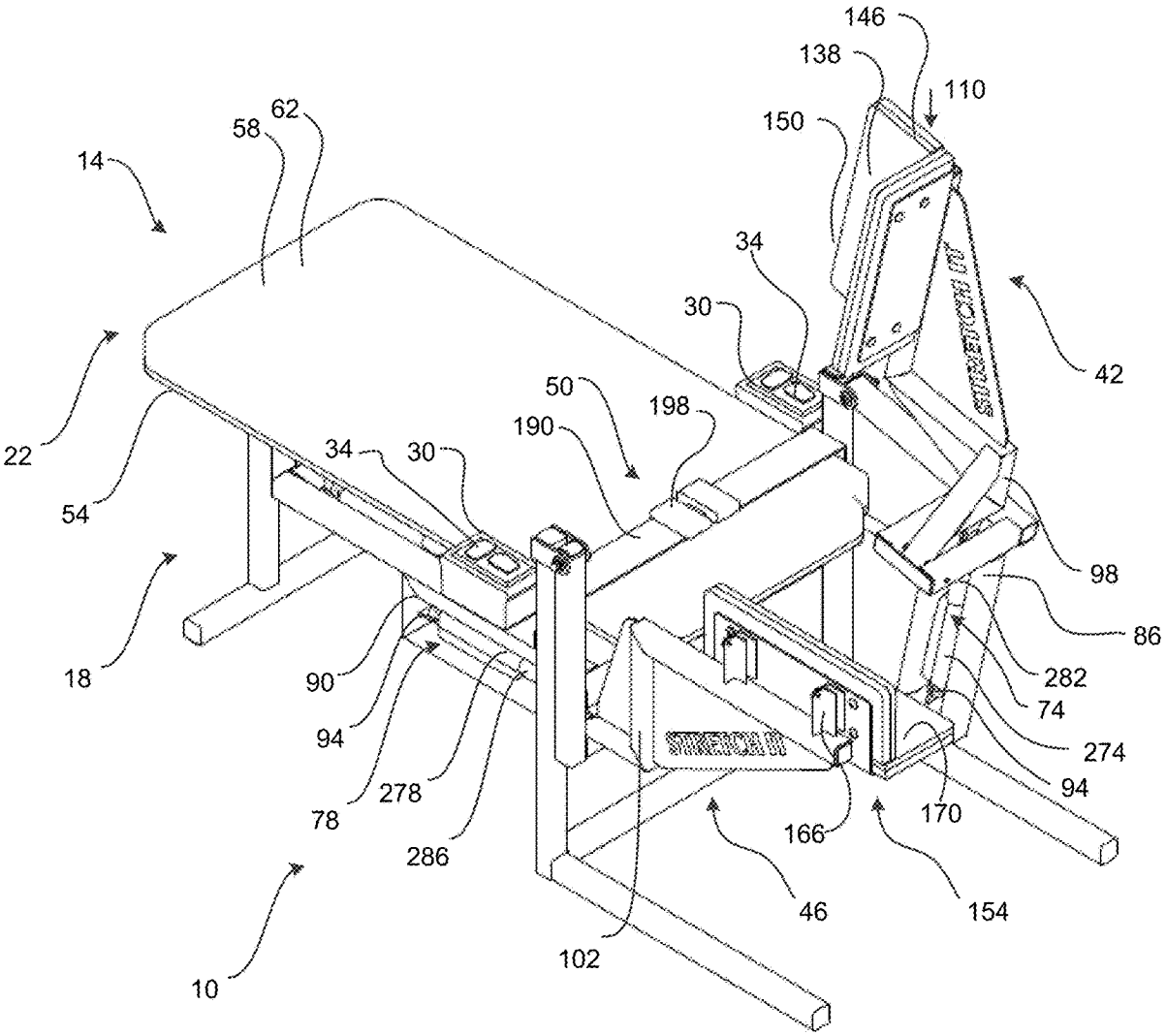
FIGS. 2A and 2B illustrate a perspective view and a side view, respectively, of the lateral hip and leg stretching machine demonstrating the left leg rest in a first stretching position and the right leg rest in the neutral position.
Figure 3A:
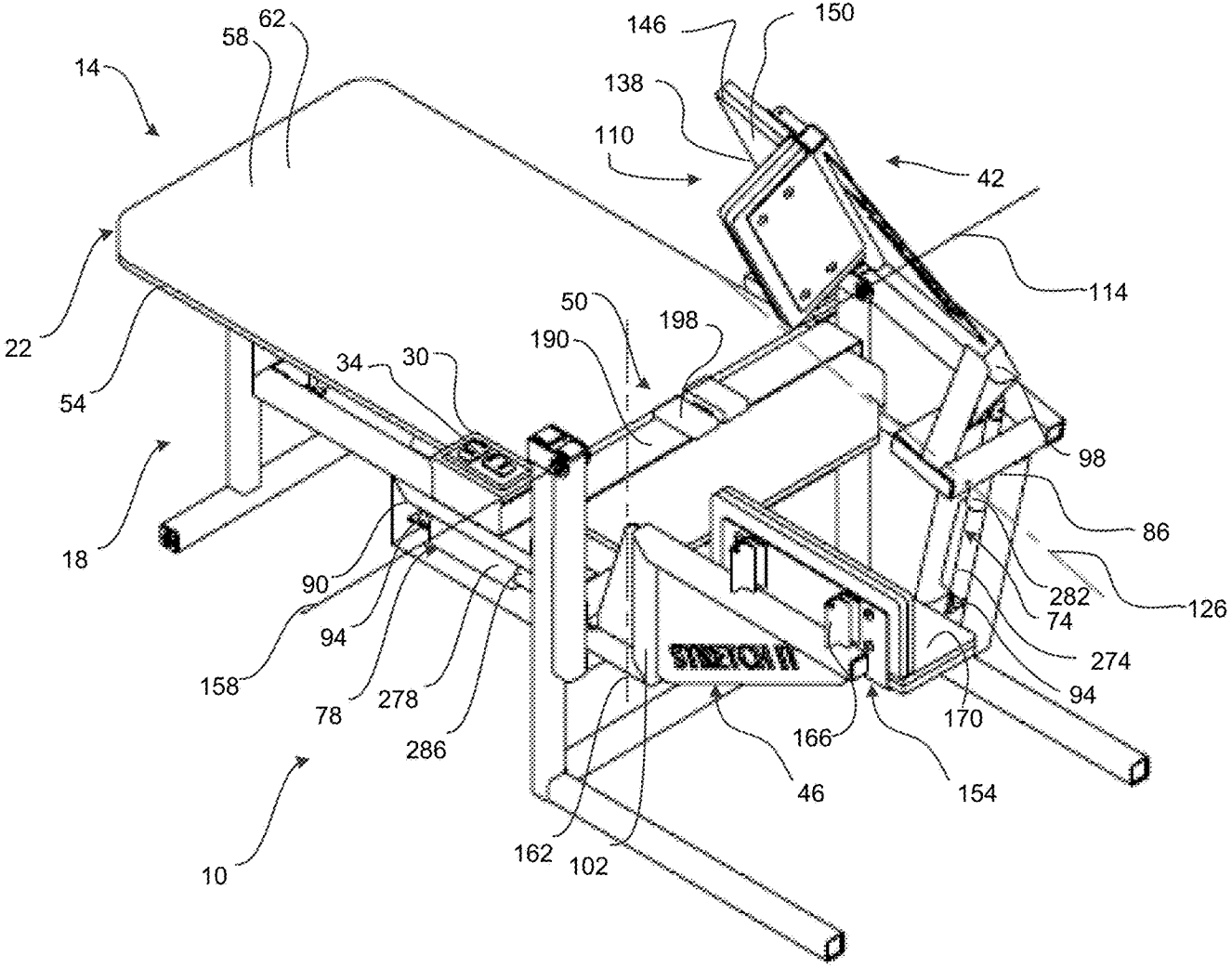
FIGS. 3A and 3B illustrate a perspective view and a side view, respectively, of the lateral hip and leg stretching machine demonstrating the left leg rest in a second stretching position and the right leg rest in the neutral position.

Now referring to FIGS. 1A, 2A, and 3A, the hip restraint belt 50 is secured to either side of the lateral hip and stretching machine 10. In some embodiments, the hip restraint belt 50 is a nylon belt. In other embodiments, the hip restraint belt 50 may be a fabric belt of a different material such as cotton, polyester, a blended fabric, or another suitable fabric. The hip restraint belt 50 includes padded cushions 186 having a cover 190 for comfort. In some embodiments, the cover 190 may be an antimicrobial fabric for hygienic cleanliness. The patient 26 may adjust the position of the hip restraint belt cushions 186 to properly restrain movement of the pelvic bone 194 during the stretch. The hip restraint belt 50 may also include a latch, clasp, or fastener 198 that allows the patient to adjust the length of the belt to the appropriate length. In some embodiments, the latch 198 may be an ergonomic quick release latch mechanism, such as, for example, a seat belt latch mechanism, a side release buckle, or other quick release buckle or latch. In other embodiments, the hip restraint belt 50 may include a different latch mechanism for securing the belt, such as, for example, a conventional buckle (or belt buckle), a slide buckle, a cam buckle, a box-frame buckle, or other latch mechanism.

Figure 9:
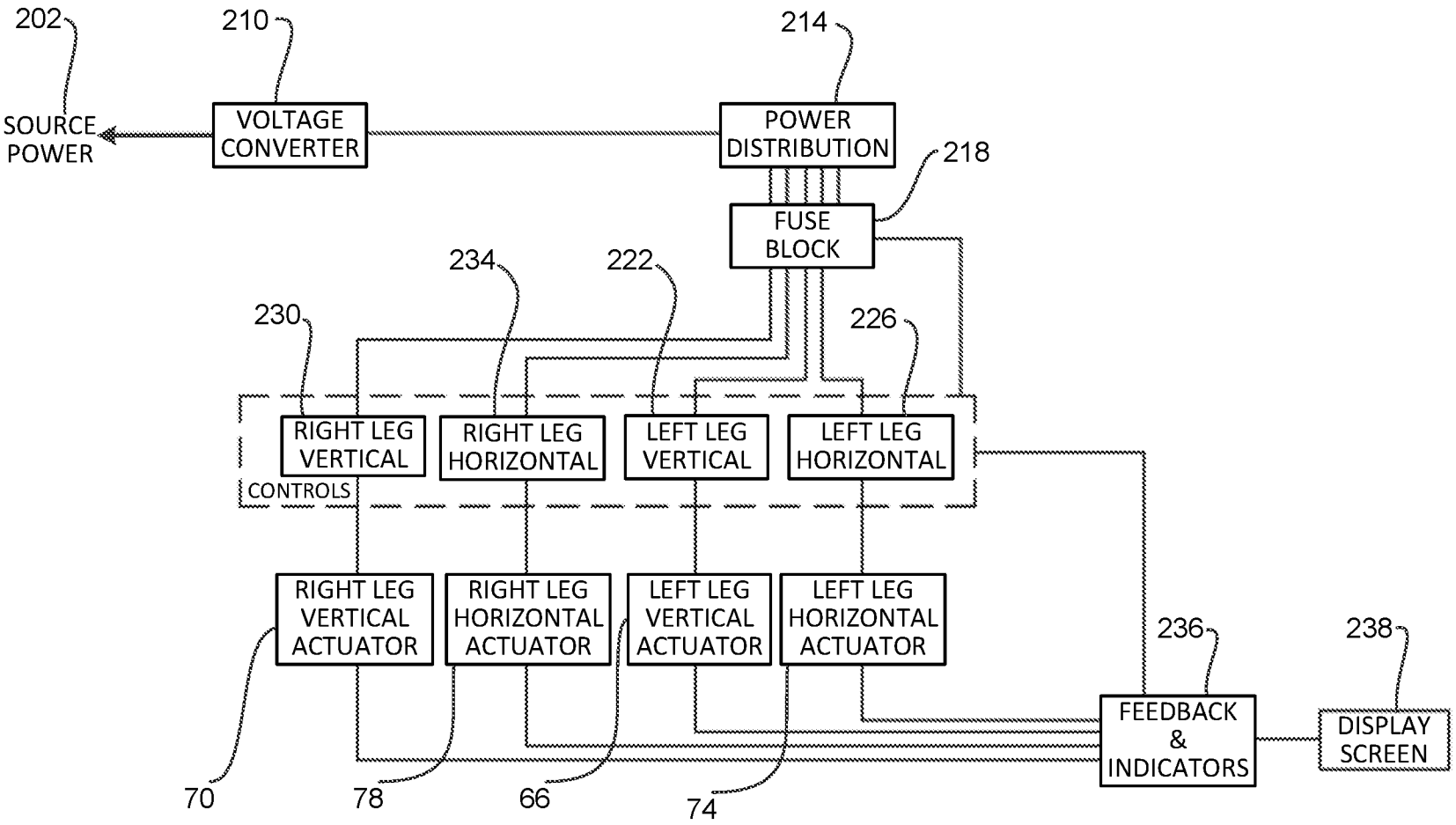
FIG. 9 illustrates a functional block diagram of electrical components of the lateral hip and leg stretching machine.

Now referring to FIG. 9, the primary electrical components of an embodiment of the lateral hip and leg stretching machine 10 are illustrated. A power source 202 supplies electrical power to a voltage converter 210. In some embodiments, the power source 202 may be, for example, a standard source power outlet connected to the voltage converter 210 by a power cable. Input voltage can be configured for AC or DC power. A power distribution panel 214 connects the converted electrical power to a fuse block 218 housing fuses for each system component (e.g., the linear actuators 66, 70, 74, 78). Four control outputs 222, 226, 230, 234 control the left leg vertical linear actuator 66, left leg horizontal linear actuator 74, right leg vertical linear actuator 70, and right leg horizontal linear actuator 78, respectively. A feedback circuit 236 can be incorporated to provide the patient 26 with position, force and other feedback indicators. A user input/output screen 238 can display stretch results for all feedback and track this data for the user's knowledge and record keeping. Force limits can be set to prevent injury to the patient 26.

Controls 222, 226, 230, 234 for each actuator 66, 70, 74, 78 can be discrete switches or implemented using a touch screen interface depending on the particular embodiment. Independent controls 222, 226, 230, 234 for each of the four (4) actuators 66, 70, 74, 78 are provided to enable the patient 26 to input the desired level of stretch for each leg. All controls have the appropriate ingress protection rating to prevent contamination inside the control and electrical enclosures.

Figure 10:
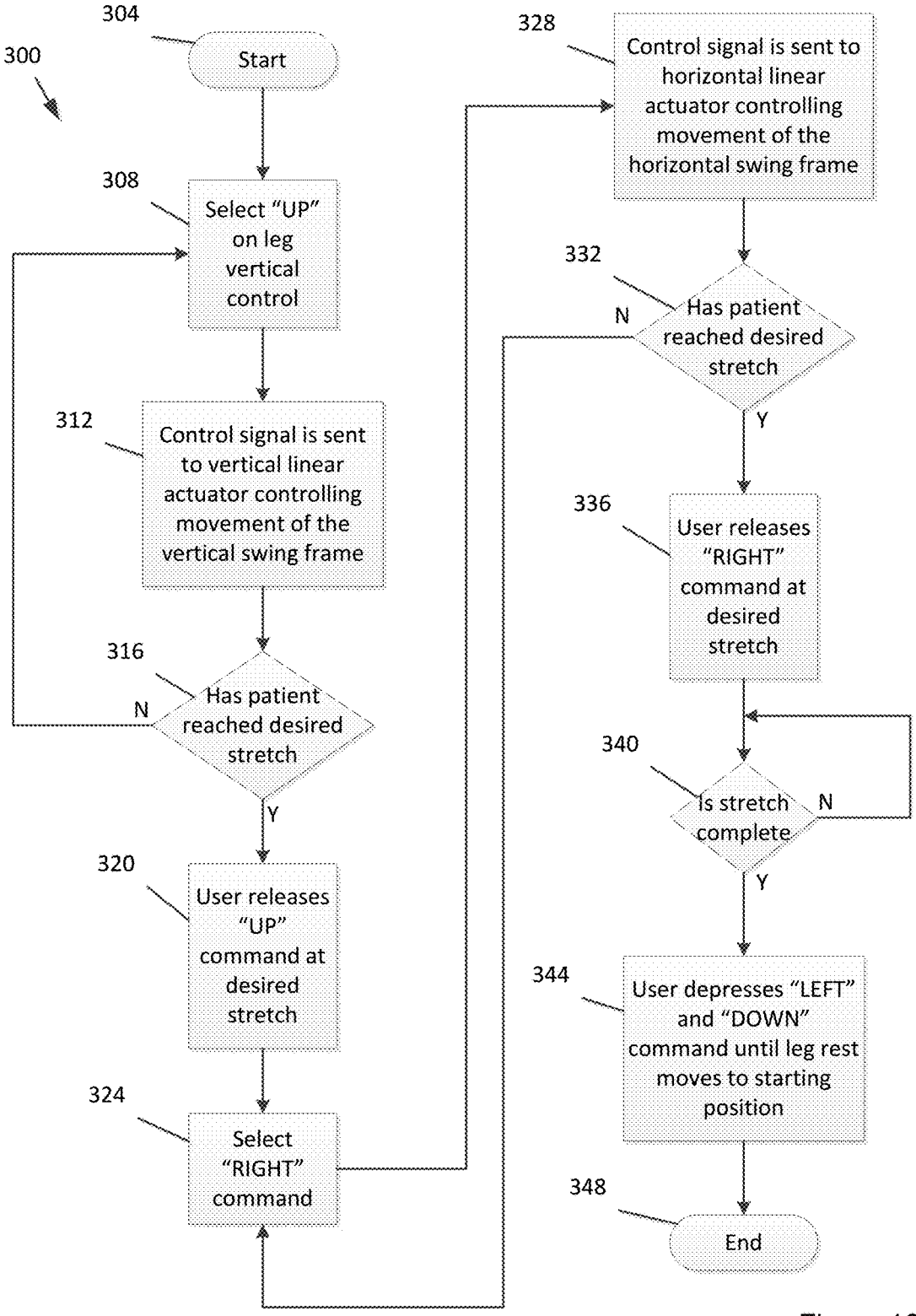
FIG. 10 illustrates a flow chart of a method of using the lateral hip and leg stretching machine.

A method 300 of using the lateral hip and leg stretching machine 10 is illustrated in FIG. 10. For description purposes, the method 300 will first be described according to an IT band stretch of the left leg 122. However, the same method 300 is applicable for an IT band stretch of the right leg 130, described thereafter. The method 300 starts at 304. Referring to FIG. 1B, to begin use of the lateral hip and leg stretching machine 10, the patient 26 is properly situated on the table 14, and each leg 122, 130 is positioned on the respective left leg rest 42 or right leg rest 46. The patient 26 achieves a fully flat, horizontal position on the patient's back 240. The hip restraint belt 50 and the padded cushion 186 are adjusted to fit comfortably over the patient's hips 118 and pelvic bone 194 to ensure the patients' torso 242 and lower back 246 do not rotate during the operation of the lateral hip and leg stretching machine 10. At the start of the stretch sequence, the right leg rest 46 and left leg rest 42 are in the horizontal, resting, or neutral position, as shown in FIGS. 1A and 1B. When ready, the patient 26 has full control over the position controls of each leg rest 42, 46.

Figure 2B:
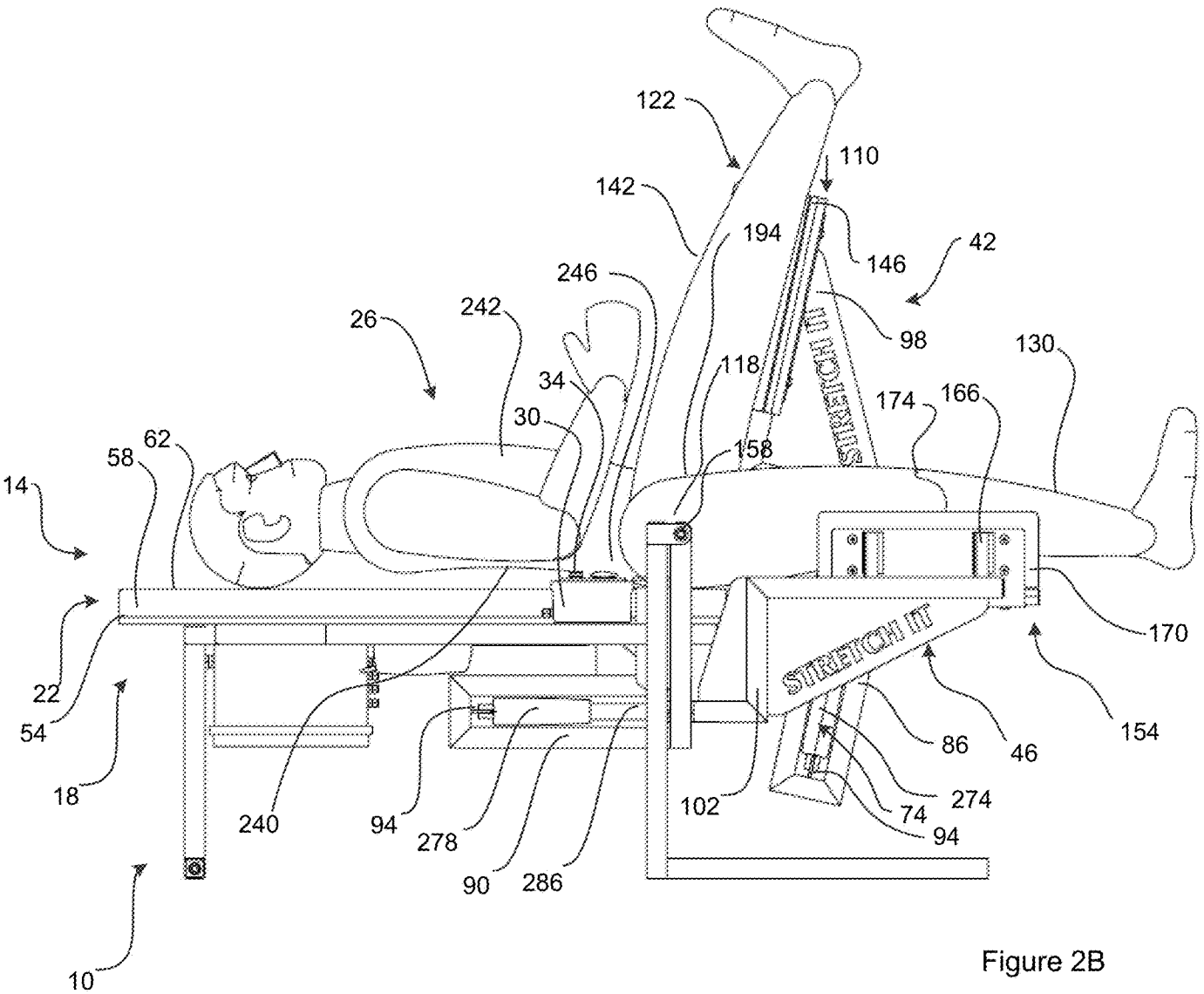

At 308, the user or operator selects the left leg vertical control and selects "UP". At 312, left leg vertical control (for example, a switch) sends a control signal to the left vertical linear actuator 66 that controls the movement of the left vertical swing frame 86. Referring additionally to FIGS. 2A and 2B, the first motion in the IT band stretch of the left leg 122, the vertical motion, is illustrated. A body 250 of the left vertical linear actuator 66, which is pinned to the underside of the table 14, is allowed to pivot about a lateral axis $\alpha$ of the table 14 but is otherwise restrained from movement.

Movement of the left vertical linear actuator 66 is based on an extension rod 258 that extends from an actuator body 250 of the left vertical linear actuator 66. As previously stated, as the screw 270 is turned by the motor and gear assembly 266, the extension rod 258 extends or retracts in response to the control input by the patient 26. This extension and retraction controls the position of the left vertical swing frame 86 and the position of the patient's left leg 122 to enable the stretch of the leg muscle.

Although the left leg rest 42 is shown in the maximum vertical position for reference (for example, at 90°), the patient 26 controls the vertical position during an actual stretch and, therefore, may position the left leg rest 42 at an angle within a range, for example, of 0° to 90°. In addition, although a left leg stretch is being used as an example, a stretch of the right leg is similar, although the right leg rest 46 and linear actuators 70, 78 are used and the horizontal rotation is in the opposite direction.

Figure 3B:
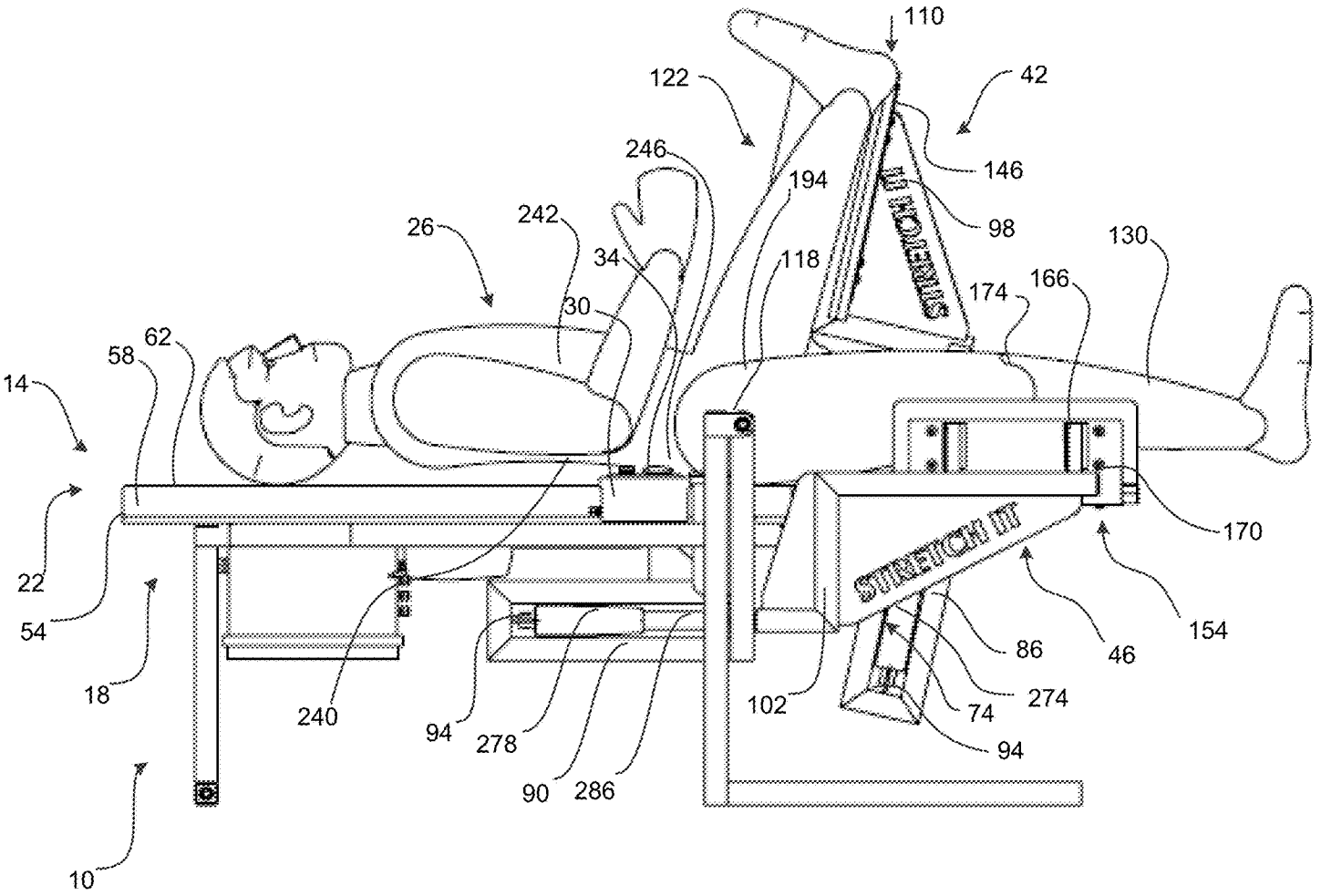
Figure 4:
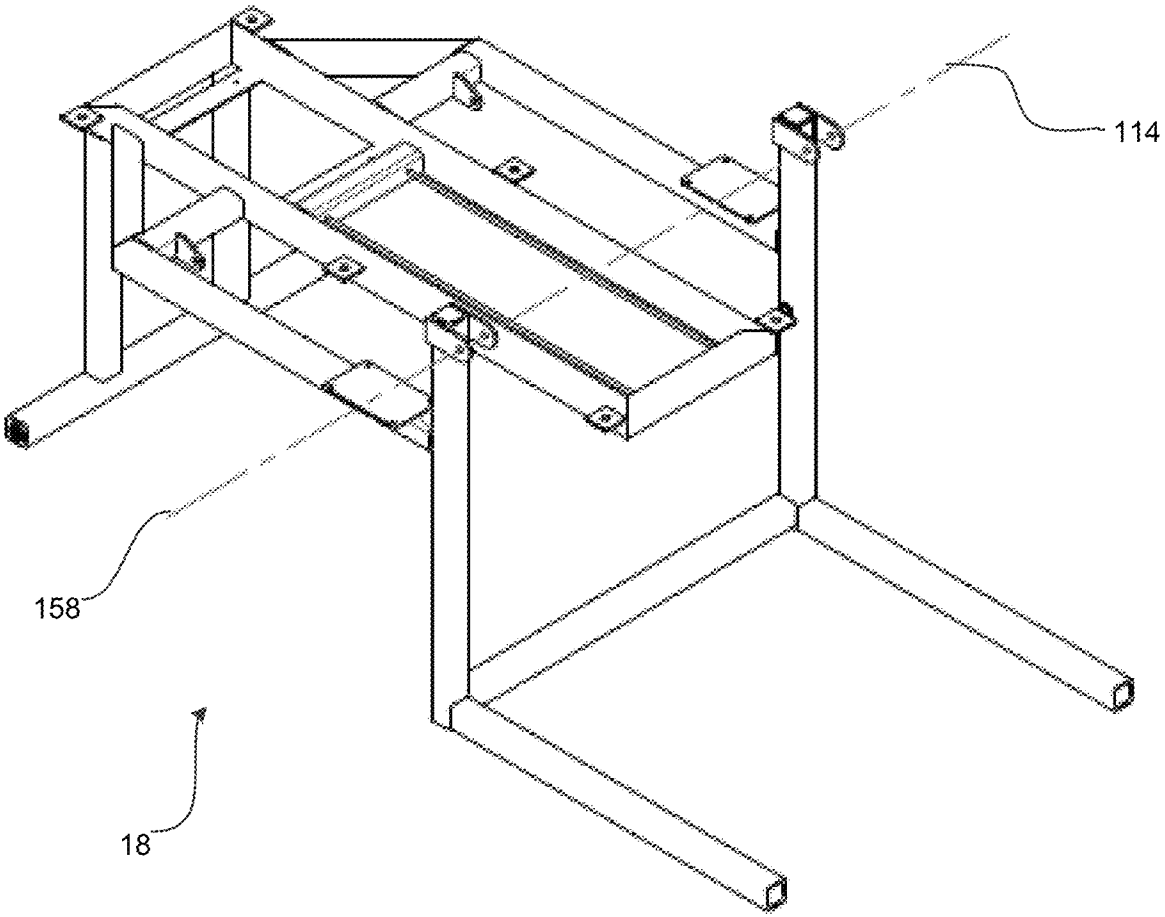
FIG. 4 illustrates a perspective view of a frame of the lateral hip and leg stretching machine.

At 316, the method 300 determines whether the patent 26 has reached the desired vertical stretch. If the patient 26 has not reached the desired stretch, the patient 26 continues to depress the "UP" command at 308. If the patient 26 has reached the desired stretch at 316, the patient or user 26 releases the "UP" command at the desired stretch position at 320. Once the patient 26 is ready, they next operate the "RIGHT" command at 324, which initiates the second motion. Referring additionally to FIGS. 3A and 3B, the second motion in the IT band stretch of the left leg 122, the horizontal motion, is illustrated. Although the left leg rest 42 is shown in the maximum horizontal position (for example, at 85°) for reference, the patient 26 controls the horizontal position during an actual stretch, and, therefore, the left leg rest 42 may be positioned at an angle within the range of, for example 0° and 85°.

At 328, the "RIGHT" command (for example, a switch) sends a control signal to the left horizontal linear actuator 74 that controls the position of the left horizontal swing frame 98. A body 274 of the left horizontal linear actuator 74, which is pinned to the left vertical swing frame 86, is allowed to pivot about a longitudinal axis 13 of the table 14 but is otherwise restrained from movement. Movement of the left horizontal linear actuator 74 is based on an extension rod 282 that extends from the actuator body 274 of the left horizontal linear actuator 74. The left horizontal linear actuator extension rod 282 is pinned to the left horizontal swing frame 98 such that the left horizontal swing frame 98 pivots, enabling the stretch of the leg muscle.

Similar to the vertical linear actuator 66 and as previously stated, as screw 270 is turned by motor and gear assembly 266, the extension rod 282 extends or retracts in response to the control input by the patient 26. This extension and retraction controls the position of the horizontal swing frame 98 and the position of the patient's left leg 122 to enable the stretch of the leg muscle.

At 332, the method 300 determines whether the patient has reached the desired horizontal stretch. If the patient has not reached the desired stretch, the patient 26 continues to depress the "RIGHT" command at 324. If the desired stretch has been achieved, at 332, the patient 26 releases the "RIGHT" command at 336, and the lateral hip and leg stretching machine 10 remains stationary, allowing the patient 26 to maintain the stretch for the desired amount of time.

The patient 26 can continue to depress the "UP" or "RIGHT" commands in any combination to achieve the desired stretch. At 340, the method 300 determines whether the stretch is complete. If the stretch is not complete, the lateral hip and leg stretching machine 10 continues to remain stationary, allowing the patient 26 to maintain the stretch for the desired amount of time. If the stretch is complete at 340, the patient 26 depresses the "LEFT" command and the "DOWN" command until the left leg rest 42 moves to its starting position at 344. The method 300 then ends at 348.

As necessary, the patient repeats method 300 for the right leg rest 46 to perform a right leg stretch, which mirrors the motions discussed above for the left leg rest 42 and the left leg stretch. The method 300 starts at 304. As described above, and in relation to FIGS. 1A and 1B, at the start of the method 300, the patient 26 is properly situated on the table 14 in a fully flat, horizontal position on the patient's back 240. Each leg 122, 130 is positioned on the respective left leg rest 42 or right leg rest 46 which are both in the horizontal, resting, or neutral position. The hip restraint belt 50 and the padded cushion 186 are adjusted to fit comfortably over the patient's hips 118 and pelvic bone 194 to ensure the patients' torso 242 and lower back 246 do not rotate during the operation of the lateral hip and leg stretching machine 10. When ready, the patient 26 has full control over the position controls of each leg rest 42, 46.

At 308, the user or operator selects the right leg vertical control and selects "UP". At 312, right leg vertical control (for example, a switch) sends a control signal to the right vertical linear actuator 70 that controls the movement of the right vertical swing frame 90. Movement of the right vertical linear actuator 70 is based on an extension rod 262 that extends from an actuator body 254 of the right vertical linear actuator 70. As previously stated, as the screw 270 is turned by the motor and gear assembly 266, the extension rod 262 extends or retracts in response to the control input by the patient 26. This extension and retraction controls the position of the right vertical swing frame 90 and the position of the patient's right leg 130 to enable the stretch of the leg muscle. The patient 26 controls the vertical position of the right leg rest 46, and, therefore, may position the right leg rest 46 at a vertical angle within a range, for example, of 0° to 90°.

At 316, the method 300 determines whether the patent 26 has reached the desired vertical stretch. If the patient 26 has not reached the desired stretch, the patient 26 continues to depress the "UP" command at 308. If the patient 26 has reached the desired stretch at 316, the patient 26 releases the "UP" command at the desired stretch position at 320. Once the patient 26 is ready, they next operate a "LEFT" command (for example, a switch) at 324, which initiates the second motion. The patient 26 controls the horizontal position of the right leg rest 46, and, therefore, the right leg rest 46 may be positioned at a horizontal angle within a range of, for example 0° and 85°.

At 328, the "LEFT" command sends a control signal to the right horizontal linear actuator 78 that controls the position of the right horizontal swing frame 102. Movement of the right horizontal linear actuator 78 is based on an extension rod 286 that extends from an actuator body 278 of the right horizontal linear actuator 78. The right horizontal linear actuator extension rod 286 is pinned to the right horizontal swing frame 102 such that the right horizontal swing frame 102 pivots, enabling the stretch of the leg muscle.

Similar to the right vertical linear actuator 70 and as previously stated, as screw 270 is turned by motor and gear assembly 266, the extension rod 286 extends or retracts in response to the control input by the patient 26. This extension and retraction controls the position of the right vertical swing frame 90 and the position of the patient's right leg 130 to enable the stretch of the leg muscle At 332, the method 300 determines whether the patient has reached the desired horizontal stretch. If the patient has not reached the desired stretch, the patient 26 continues to depress the "LEFT" command at 324. If the desired stretch has been achieved, at 332, the patient 26 releases the "LEFT" command at 336, and the lateral hip and leg stretching machine 10 remains stationary, allowing the patient 26 to maintain the stretch for the desired amount of time.

The patient 26 can continue to depress the "UP" or "LEFT" commands in any combination to achieve the desired stretch. At 340, the method 300 determines whether the stretch is complete. If the stretch is not complete, the lateral hip and leg stretching machine 10 continues to remain stationary, allowing the patient 26 to maintain the stretch for the desired amount of time. If the stretch is complete at 340, the patient 26 depresses the "RIGHT" command and the "DOWN" command until the right leg rest 46 moves to its starting position at 344. The method 300 then ends at 348.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A stretching machine comprising:
- a table having a surface for supporting a patient;
- a first leg rest for supporting and moving a first leg of the patient, the first leg rest including:
  - a first vertical frame operable to rotate around a first horizontal pivot point at an end of the table; and
  - a first horizontal frame operable to rotate around a first vertical pivot point on the first vertical frame;
- a first vertical actuator for rotating the first vertical frame around the first horizontal pivot point to move the first leg rest in a vertical direction relative to the surface of the table; and
- a first horizontal actuator for rotating the first horizontal frame around the first vertical pivot point to move the first leg rest in a horizontal direction relative to the first vertical frame.

2. The stretching machine of claim 1, further comprising:
- a second leg rest for supporting and moving a second leg of the patient, the second leg rest comprising:
  - a second vertical frame operable to rotate around a second horizontal pivot point at an end of the table; and
  - a second horizontal frame operable to rotate around a second vertical pivot point on the second vertical frame;
- a second vertical actuator for rotating the second vertical frame around the second horizontal pivot point to move the second leg rest in a vertical direction relative to the surface of the table; and
- a second horizontal actuator for rotating the second horizontal frame around the second vertical pivot point to move the leg rest in a horizontal direction relative to the second vertical frame.

3. The stretching machine of claim 1, further comprising a first vertical leg controller operable to send a control signal to the first vertical actuator to control the rotational movement of the first vertical frame around the first horizontal pivot point to move the first leg rest in the vertical direction; and
- a first horizontal leg controller operable to send a control signal to the first horizontal actuator to control the rotational movement of the first horizontal frame around the first vertical pivot point to move the first leg rest in the horizontal direction.

4. The stretching machine of claim 1, wherein the first vertical actuator comprises a linear actuator.

5. The stretching machine of claim 1, wherein the first horizontal actuator comprises a linear actuator.

6. The stretching machine of claim 1, further comprising a restraining mechanism for restraining a lower portion of a torso of the patient on the table during motion of the leg.

7. The stretching machine of claim 1, wherein the first vertical actuator rotates the first vertical frame to move the first leg rest in a vertical direction to an angle between 0 and 90 degrees relative to the surface of the table.

8. The stretching machine of claim 1, wherein the first horizontal actuator rotates the first horizontal frame to move the first leg rest in the horizontal direction to an angle between 0 and 85 degrees relative to the first vertical frame.

9. The stretching machine of claim 2, further comprising a second vertical leg controller operable to send a control signal to the second vertical actuator to control the rotational movement of the second vertical frame around the second horizontal pivot point to move the second leg rest in the vertical direction; and a second horizontal leg controller operable to send a control signal to the second horizontal actuator to control the rotational movement of the second horizontal frame around the second vertical pivot point to move the second leg rest in the horizontal direction.

10. The stretching machine of claim 2, wherein the second vertical actuator comprises a linear actuator.

11. The stretching machine of claim 2, wherein the second horizontal actuator comprises a linear actuator.

12. The stretching machine of claim 6, wherein the restraining mechanism is a restraint belt having a quick release fastener.

13. The stretching machine of claim 6, wherein the restraining mechanism is a restraint belt having a padded cushion.

14. A method for using a stretching machine having a table and at least one leg rest, the method comprising:

sending, by a vertical leg controller, a control signal to a vertical actuator controlling rotational movement of a vertical frame around a horizontal pivot point at an end of the table to move the leg rest in a vertical direction relative to a surface of the table;

sending, by a horizontal leg controller, a control signal to a horizontal actuator controlling rotational movement of a horizontal frame around a vertical pivot point on the vertical frame to move the leg rest in a horizontal direction relative to the vertical frame;

moving, by the vertical actuator, the leg rest to an angle in the vertical direction relative to the surface of the table; and moving, by the horizontal actuator, the leg rest to an angle in the horizontal direction relative to the vertical frame.

15. The method of claim 14, further comprising, selecting, by a patient, an up or down command on the vertical leg controller to control the rotational movement of the vertical frame and move the leg rest in an up or down direction relative to the surface of the table.

16. The method of claim 14, further comprising, selecting, by a patient, a left or right command on the horizontal leg controller to control the rotational movement of the horizontal frame and move the leg rest in left or right direction relative to the vertical frame.

17. The method of claim 14, wherein the angle in the vertical direction is between 0 and 90 degrees.

18. The method of claim 14, wherein the angle in the horizontal direction is between 0 and 85 degrees.

19. The method of claim 14, wherein the vertical actuator is a linear actuator.

20. The method of claim 14, wherein the horizontal actuator is a linear actuator.

* * * * *